US009585483B2

(12) United States Patent
Wu

(10) Patent No.: US 9,585,483 B2
(45) Date of Patent: Mar. 7, 2017

(54) ADJUSTABLE HEAD SUPPORT APPARATUS

(71) Applicant: Yao-Chuan Wu, Chiayi Hsien (TW)

(72) Inventor: Yao-Chuan Wu, Chiayi Hsien (TW)

( * ) Notice: Subject to any disclaimer, the term of this patent is extended or adjusted under 35 U.S.C. 154(b) by 66 days.

(21) Appl. No.: 14/754,237

(22) Filed: Jun. 29, 2015

(65) Prior Publication Data

US 2016/0374473 A1 Dec. 29, 2016

(51) Int. Cl.
*A47C 7/38* (2006.01)

(52) U.S. Cl.
CPC ..... *A47C 7/38* (2013.01)

(58) Field of Classification Search
CPC ..... A47C 1/036; A47C 1/38
USPC ..... 297/410
See application file for complete search history.

(56) References Cited

U.S. PATENT DOCUMENTS 3,376,064 A * 4/1968 Jackson ..... A47C 7/38 297/391
3,860,286 A * 1/1975 Rasmussen ..... A61G 15/125 297/408
4,451,084 A * 5/1984 Seeley ..... A47C 7/402 248/297.31
5,007,678 A * 4/1991 DeKraker ..... A47C 7/402 297/353
5,112,106 A * 5/1992 Asbjornsen ..... A47C 7/46 297/284.7
5,918,941 A * 7/1999 Kigel ..... A47C 7/383 297/353
6,273,509 B1 * 8/2001 Reithmeier ..... B60N 2/28 297/391
7,954,895 B2 * 6/2011 Freeman ..... B60N 2/2851 297/250.1
2002/0149247 A1 * 10/2002 Diffrient ..... A47C 1/03 297/321
2005/0189810 A1 * 9/2005 Wu ..... A47C 7/38 297/452.29
2008/0309139 A1 * 12/2008 Oda ..... A47C 7/38 297/410
2010/0038949 A1 * 2/2010 Liao ..... A47C 7/38 297/408
2012/0139321 A1 * 6/2012 Wu ..... A47C 7/38 297/391
2012/0200134 A1 * 8/2012 Lai ..... B60N 2/4817 297/410
2013/0234490 A1 * 9/2013 Millan ..... B60N 2/4808 297/391
2015/0246629 A1 * 9/2015 Bohm ..... B60N 2/2851 297/256.15

* cited by examiner

*Primary Examiner* — Timothy J Brindley
(74) *Attorney, Agent, or Firm* — patenttm.us

(57) ABSTRACT

An adjustable head support apparatus includes a head support and an adjusting assembly disposed within the seat back of a chair. The adjusting assembly includes a positioning base, a rotating block, a moving base and a latch base. The positioning base is disposed at a rear end of the seat back and the rotating block is pivoted within the positioning base. The moving base is installed at the rear end of the positioning base to move the head support. The latch base is installed at the front end of the head support and engaged with the latch. When the head support is pulled up enough to move the moving base upward, the moving base will rotate the latch of the rotating block. Therefore, the height of the head support can be adjusted to satisfy different people and the support of the head can be provided properly.

6 Claims, 9 Drawing Sheets

ADJUSTABLE HEAD SUPPORT APPARATUS

BACKGROUND OF THE INVENTION

1. Field of the Invention

The present invention relates to an adjustable head support apparatus, and more particularly to a head support installed at an upper end of a seat back of a chair.

2. Description of Related Art

For better sitting comfort, the functions of the chair become more and more diverse. For example, by installing the wheels, the chair is conveniently movable. By adjusting the height of the chair, the chair is suitable for people of different body sizes or for different usage circumstances. By adjusting an inclined angle of the seat back, people's back can be supported properly. Accordingly, a consumer can choose to purchase the suitable chair in accordance with personal preferences.

In order to support the neck when a person is sitting on the chair, some of the chairs will install a head support on top of the seat back. When a person is sitting on the chair and the person's back touches the seat back, the person's head can lean on the head support to fully support the whole body to feel more comfortable.

However, the conventional head support is directly installed on top of the seat back. When the head support is installed, the relative position between the head support and the seat back is fixed. Accordingly, the manufacturer designs the head support in accordance with the person of a medium body size. For a person not of the medium body size, the person's head is higher or lower than the height of the head support when he is sitting on the chair. Therefore, the head is not supported properly and the head support is useless.

Therefore, since the conventional head support is installed on the seat back and the height of the head support is not changeable, the aforementioned problems exist.

SUMMARY OF THE INVENTION

Since the conventional head support of the chair is fixed, the height of the head support is not changeable for people of different body sizes or a person under different usage circumstances. The adjustable head support in the present invention is to implement a positioning base installed in a rear end of the seat back, a rotating block pivoted within the positioning base and facing to the head support, a moving base disposed at a lower end of the positioning base, two notches disposed on two sides of a front surface of the head support, and a latch base disposed between the two notches so as to form a head support structure with adjustable height. A person can properly adjust the height of the head support in accordance with the requirement, and the head support can include a support effect for different people sitting on the chair or a person under different circumstances.

In order to achieve the aforementioned objective, the present invention is to provide an adjustable head support apparatus comprising:

- a head support disposed on a rear end of a seat back of a chair and including:
  - a bottom surface facing the rear end of the seat back;
  - two through grooves in an elongated shape respectively formed in two sides of the bottom surface of the head support;
  - two fastening elements respectively mounted through the through grooves and fixed on the seat back; and
  - two notches formed in parallel and disposed between the two through grooves; and

- an adjusting assembly disposed between the seat back and the head support, the adjusting assembly including:
  - a positioning base having:
    - a first recessed area formed below a centre of the positioning base; and
    - two second recessed areas respectively formed at two lower sides of the positioning base;
  - a rotating block pivotally mounted on the positioning base within the first recessed area and having:
    - a latch formed on and inclined from an upper end to a rear end of the rotating block; and
    - a bump formed on and extending from a lower end of the latch;
  - a moving base disposed at a rear end of the positioning base, and having:
    - a pushing sheet formed at a centre of the moving base, extending upward, and corresponding to a position of the latch of the rotating block;
    - two limiting blocks respectively protruding from two sides of a rear end of the moving base and corresponding to positions of the notches of the head support, wherein when the head support is moved up such that lower edges of the two notches contact the limiting block, the head support pulls the moving base upward; and
    - a latch base embedded between the two notches of the head support and having a plurality of one-way latches disposed horizontally on a front surface of the latch base; and
  - a torque spring disposed within a positioning groove and forcing the latch of the rotating block to rotate backward to engage with the latch base of the head support without external force.

By implementing the adjustable head support apparatus described above, the height of the head support is changeable. When the head support is pulled up, the rotating block is used to position the head support. When the head support is pulled up enough to move the moving base upward, the moving base will rotate the latch of the rotating block and the latch is not engaged with the latch base of the head support as an unlocked status. Therefore, the position of the head support can be moved down.

By implementing the adjustable head support apparatus described above, two wings are respectively formed at two sides of the moving base and extending forward and two barrier plates are respectively extending outward from a front end of the two wings. The wings are disposed at the second recessed area of two sides of the positioning base.

By implementing the wings and the barrier plates, the relative position between the moving base and the positioning base is fixed.

By implementing the adjustable head support apparatus described above, a through-hole is formed horizontally among the two second recessed areas and the first recessed area in the positioning base and a passing hole is formed at a lower end of the rotating block and corresponding to the through-hole. In addition, a rod is mounted through the through-hole, the torque spring and the passing hole, so the rotating block is pivotally mounted on the positioning base in the first recessed area.

By implementing the aforementioned pivot structure, the rotating block is rotatable within the second recessed area.

By implement the adjustable head support apparatus described above, one end of the torque spring is against a peripheral end of the positioning groove to form a positioning point and the other end of the torque spring is inserted at one side of the front end of the rotating block to rotate the latch of the rotating block backward.

By the position of the aforementioned torque spring, the latch is rotated backward and engaged with the latch base of the head support when external force does not exist in the rotating block.

DETAILED DESCRIPTION OF THE PREFERRED EMBODIMENT

Figure 1:
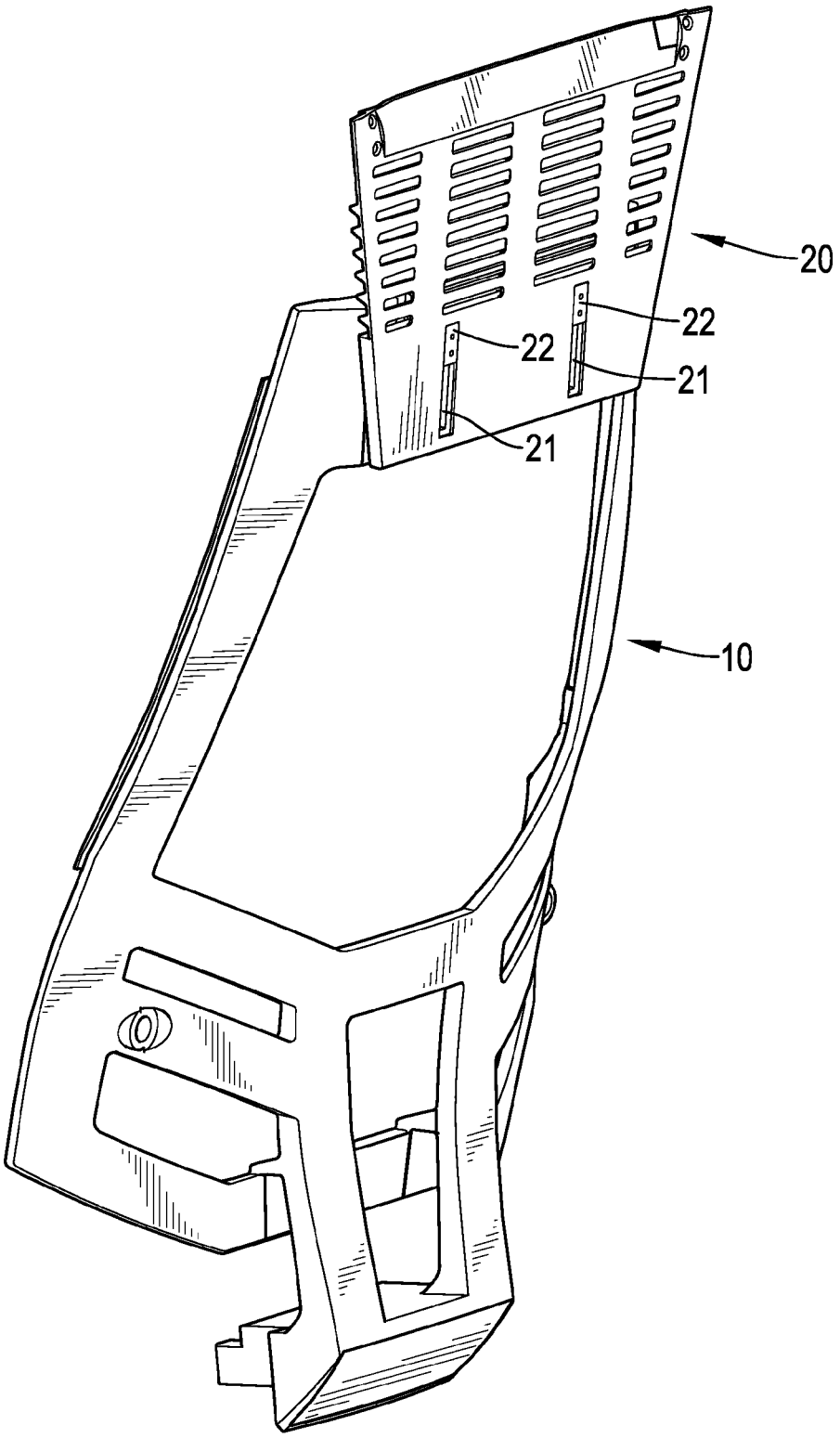
FIG. 1 is a perspective back view of a head support of the present invention installed in a seat back.

With reference to FIG. 1, the adjustable head support apparatus in the present invention includes a head support 20, an adjusting assembly and a torque spring 43, and is disposed between a seat back 10 of a chair and the head support 20. The head support 20 includes a bottom surface, two through grooves 21, two fastening elements 22 and two notches 23. The two through grooves 21 in an elongated shape are respectively formed at two sides of the bottom surface of the head support 20. The head support 20 is disposed at an upper end of the seat back 10 by implementing the fastening elements 22 through the through grooves 21. The fastening elements 22 are fixed on the seat back 10. The head support 20 can move up and down in accordance with the relative relationship between the fastening element 22 and the through groove 21, and a moving distance of the head support 20 is determined by the length of the through groove 21.

Figure 2:
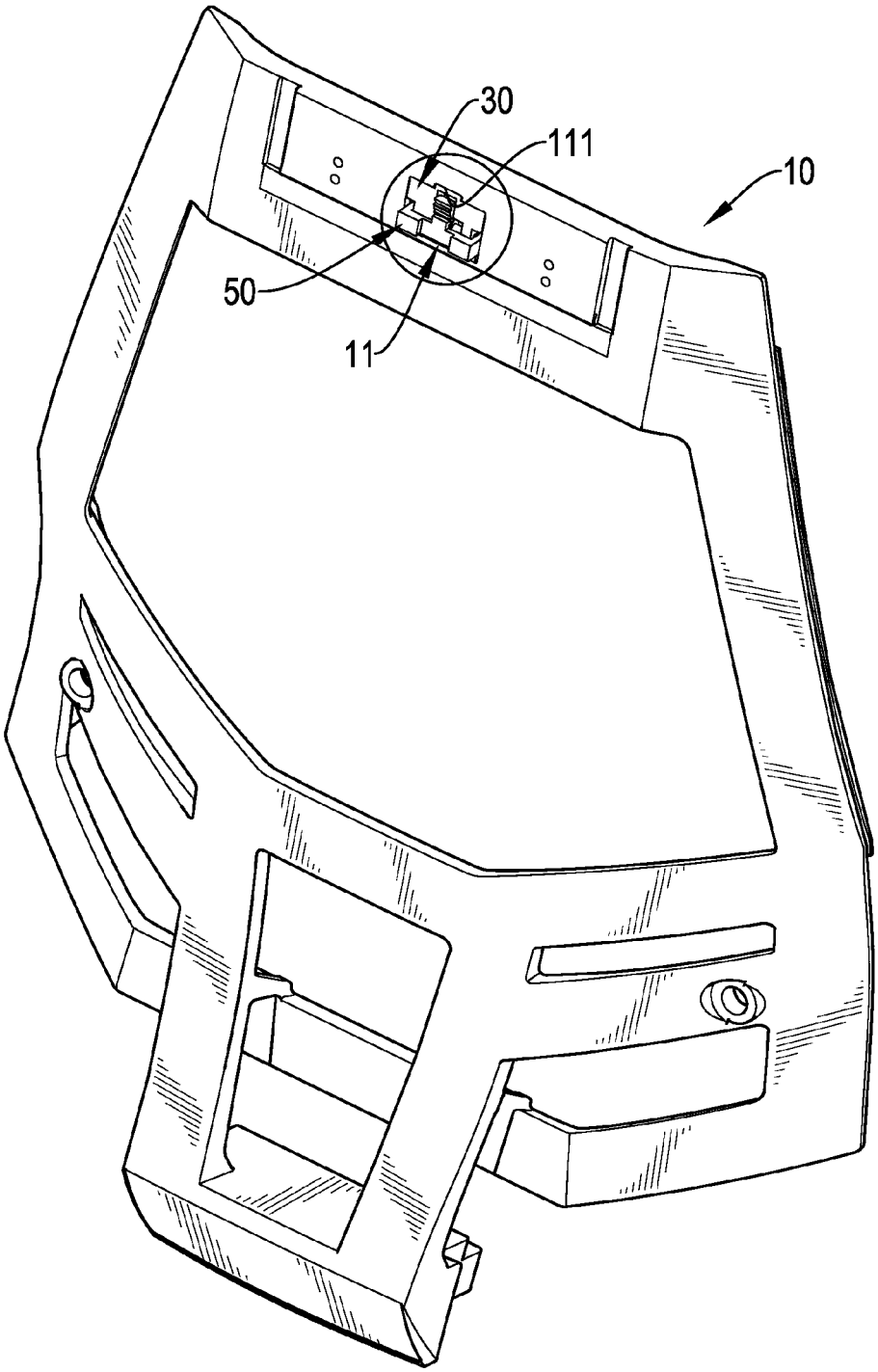
FIG. 2 is a perspective back view illustrating that the head support in the present invention is removed and the adjusting assembly is in the seat back.
Figure 3:
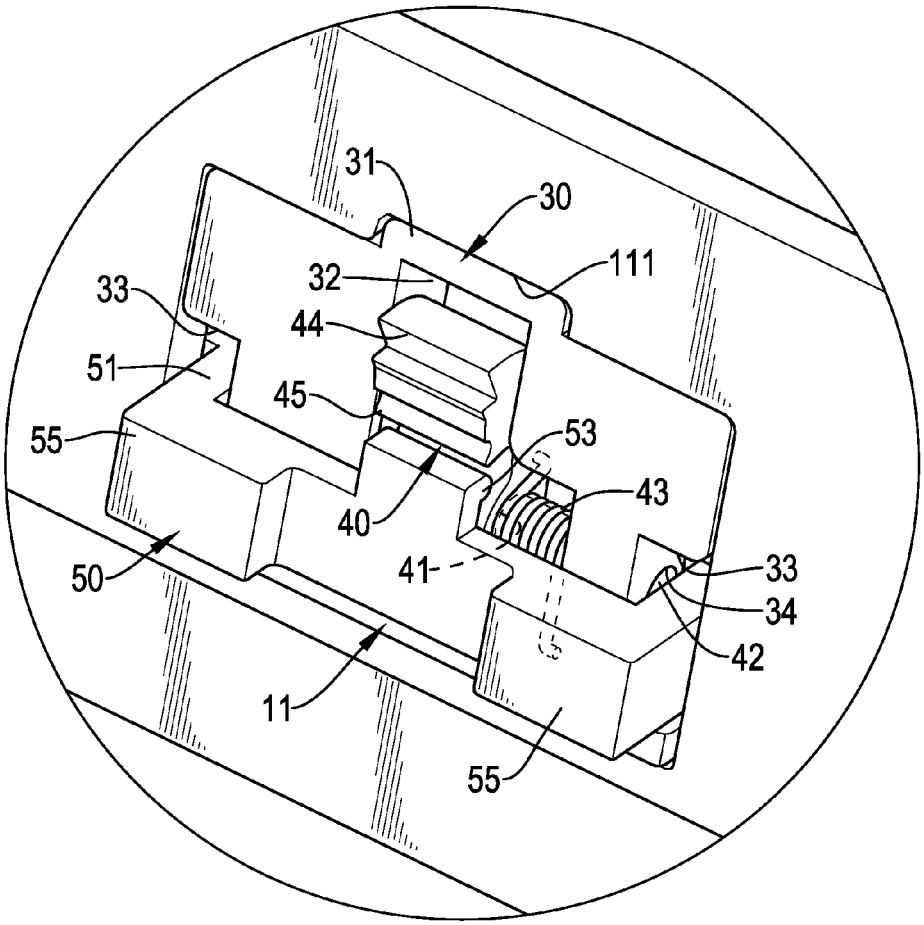
FIG. 3 is a partial enlarged view of the encircled part shown in FIG. 2.

The adjusting assembly is disposed between the head support 20 and the seat back 10. With reference to FIG. 2 and FIG. 3, the adjusting assembly includes a positioning base 30, a rotating block 40, a moving base 50 and a latch base 60. A positioning groove 11 is located at a rear end of the seat back 10 and the positioning base 30 is disposed within the positioning groove 11. The positioning base 30 includes a first recessed area 32 and two second recessed areas 33. A protruding portion 31 is formed at an upper end of a centre of the positioning base 30, so the protruding portion 31 can be positioned within a concave portion 111 at an upper end of the positioning groove 11. The first recessed area 32 is formed at a lower end of the protruding portion 31 and below the centre of the positioning base 30. The two second recessed areas 33 are respectively formed at two lower sides of the positioning base 30. A through-hole 34 is formed among the second recessed areas 33 and the first recessed area 32 and through the positioning base 30.

The rotating block 40 is pivotally mounted on the positioning base 30 within the first recessed area 32 and includes a latch 44 and a bump 45. The rotating block 40 is disposed within the first recessed area 32 of the positioning base 30 and a passing hole 41 is formed at a lower end of the rotating block 40 and is corresponding to the through-hole 34 of the positioning base 30. When the rotating block 40 is disposed within the first recessed area 32, a rod 42 is mounted into one side of the through-hole 34, the torque spring 43, the passing hole 41 and the other side of the through-hole 34, and the rotating block 40 is pivotally mounted on the positioning base 30 in the first recessed area 32. At this moment, one end of the torque spring 43 is fixed at an edge of the positioning groove 11 to form the positioning point and the other end of the torque spring 43 is inserted at one side of the upper end of the rotating block 40. The rotating block 40 applies a rotating force from the upper end to the rear end of the seat back 10 by the torque spring 43 when an external force does not exist. The latch 44 is formed on and inclined from the upper end to the rear end of the aforementioned rotating block 40 and the bump 45 extends from the lower end of the latch 44. The torque spring 43 is disposed within the positioning groove 11 and forcing the latch 44 of the rotating block 40 to rotate backward to engage with the latch base 60 of the head support 20 without external force.

Figure 4:
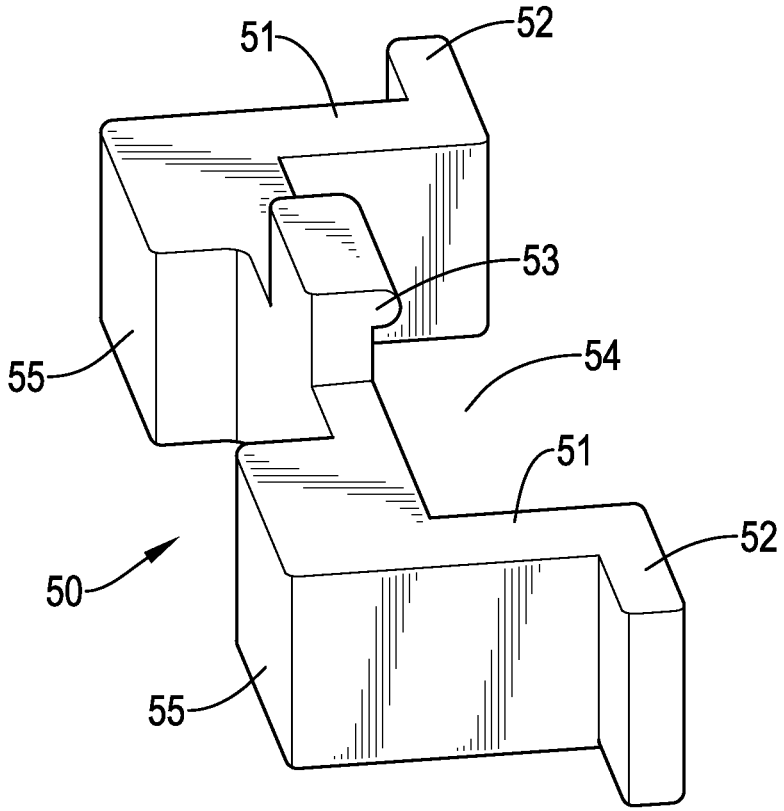
FIG. 4 is a perspective view of a moving base of the adjusting assembly in the present invention.

The moving base 50 is disposed at the rear end of the positioning base 30 and includes a pushing sheet 53, two limiting blocks 55 and the latch base 60. With reference to FIG. 4, FIG. 4 shows that the moving base 50 is rotated toward the front end of the seat back 10 and two wings 51 are formed at two sides of the moving base 50 and are extended forward. Two barrier plates 52 are respectively formed at two front ends of the two wings 51 and extended from the front ends of the two wings 51. The wings 51 are disposed within the second recessed area 33 at two sides of the positioning base 30. The pushing sheet 53 is protruded from the front end of a positioning space 54 of the two wings 51. The two limiting blocks 55 are respectively formed and protruded from two rear sides of the moving base 50.

With reference to FIG. 3, the method to assemble the positioning base 30, the rotating block 40 and the moving base 50 within the positioning groove 11 of the seat back 10 is begun from the front end of the seat back 10. The rotating block 40 is assembled in accordance with the aforementioned description and disposed within the first recessed area 32 of the positioning base 30. The moving base 50 is placed into the positioning groove 11 from the front end of the seat back 10. Therefore, the barriers plates 52 of the two wings 51 at the two sides of the moving base 50 are against the front end of the seat back 10 and the positioning base 30 is disposed at the front end of the moving base 50. Accordingly, the two wings 51 at the two sides of the moving base 50 are located at the second recessed area 33 of the positioning base 30. When a rear board at the front end of the seat back is fixed, the aforementioned adjusting assembly is positioned at the rear end of the seat back 10. At this moment, the pushing sheet 53 of the moving base 50 is located at the lower end of the latch 44 of the rotating block 40. The latch 44 of the rotating block 40 is protruded from the rear end of the pushing sheet 53 by an elastic force of the torque spring 43 and an interval is formed between the upper end of the second recessed area 33 and the wings 51 of the moving base 50.

Figure 5:
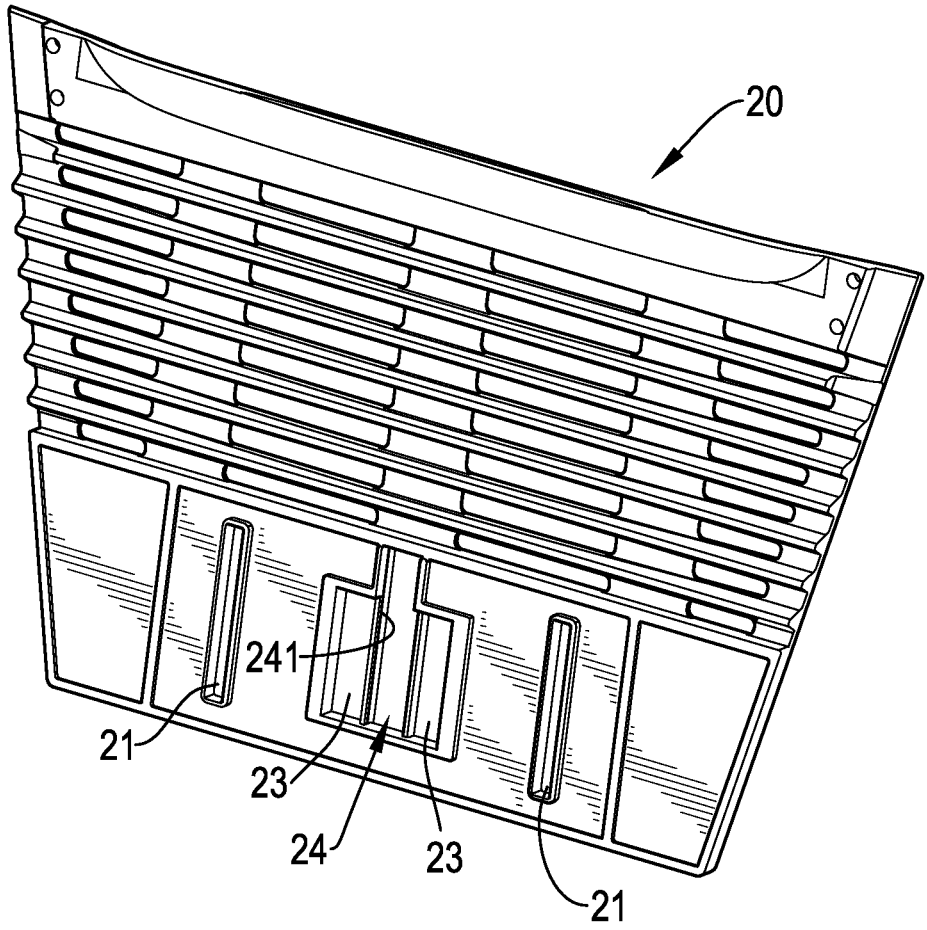
FIG. 5 is a perspective front view of the head support in the present invention.
Figure 6:
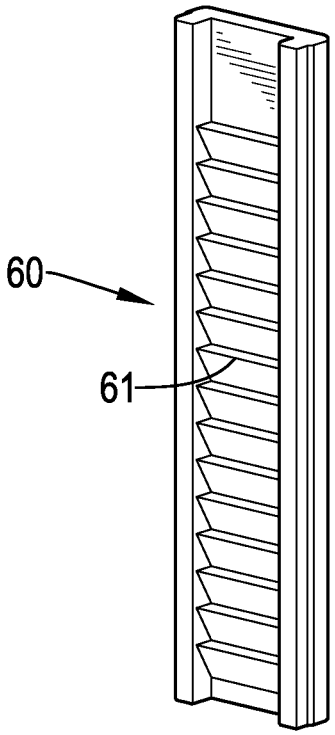
FIG. 6 is a perspective view of the latch base.
Figure 7:
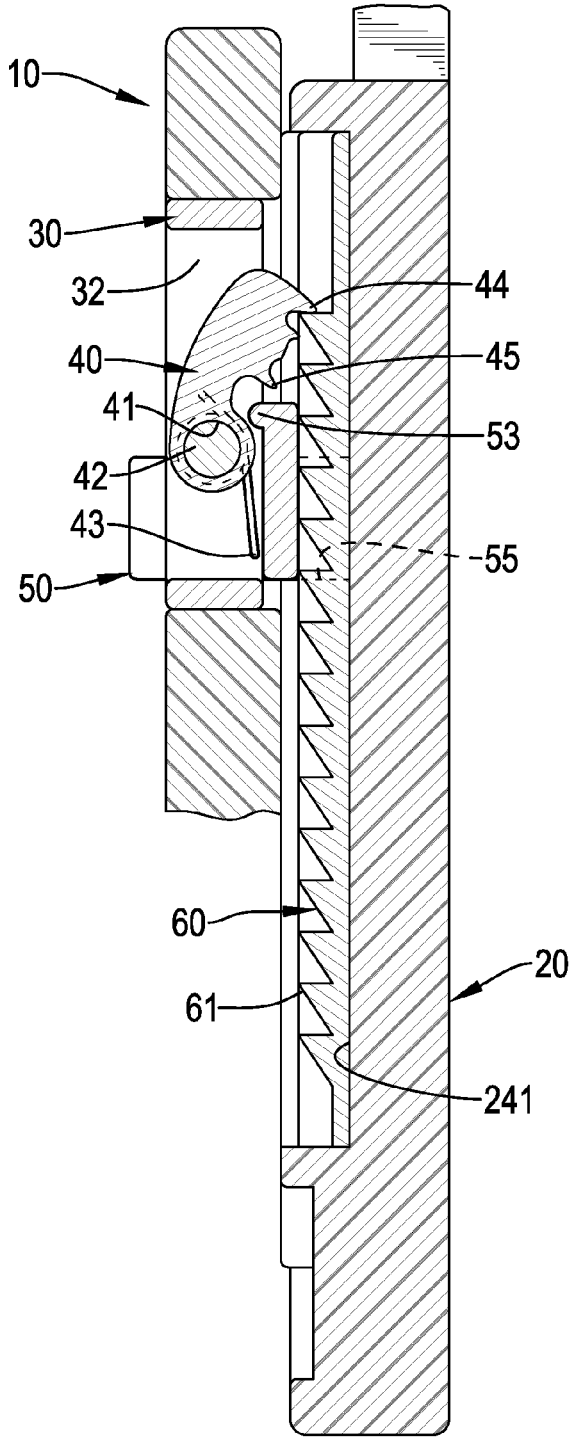
FIG. 7 is a first sectional operational view of height adjustment of the head support in the present invention.

With reference to FIG. 5, the two notches 23 are formed in parallel between the through grooves 21 and located at a front surface of the head support 20, and the latch base 60 is embedded within the two notches 23. With reference to FIG. 6, the embedding method is to form a fixing groove 24 corresponding to positions of the head support 20 and the fixing groove 24 is disposed between the two notches 23. A block 241 with a ladder shape is formed at a peripheral edge of the fixing groove 24. When the latch base 60 in an elongated shape is positioned corresponding to the fixing groove 24, the latch base 60 is embedded within the fixing groove 24. A plurality of one-way latches 61 are horizontally formed at a front surface of the latch base 60. When the head support 20 is disposed at the rear end of the seat back 10 as shown in FIG. 1, the latch base 60 is corresponding to a position of the rotating block 40 as shown in FIG. 7 and the limiting blocks 55 at the two sides of the moving base 50 are located within the notches 23.

Figure 8:
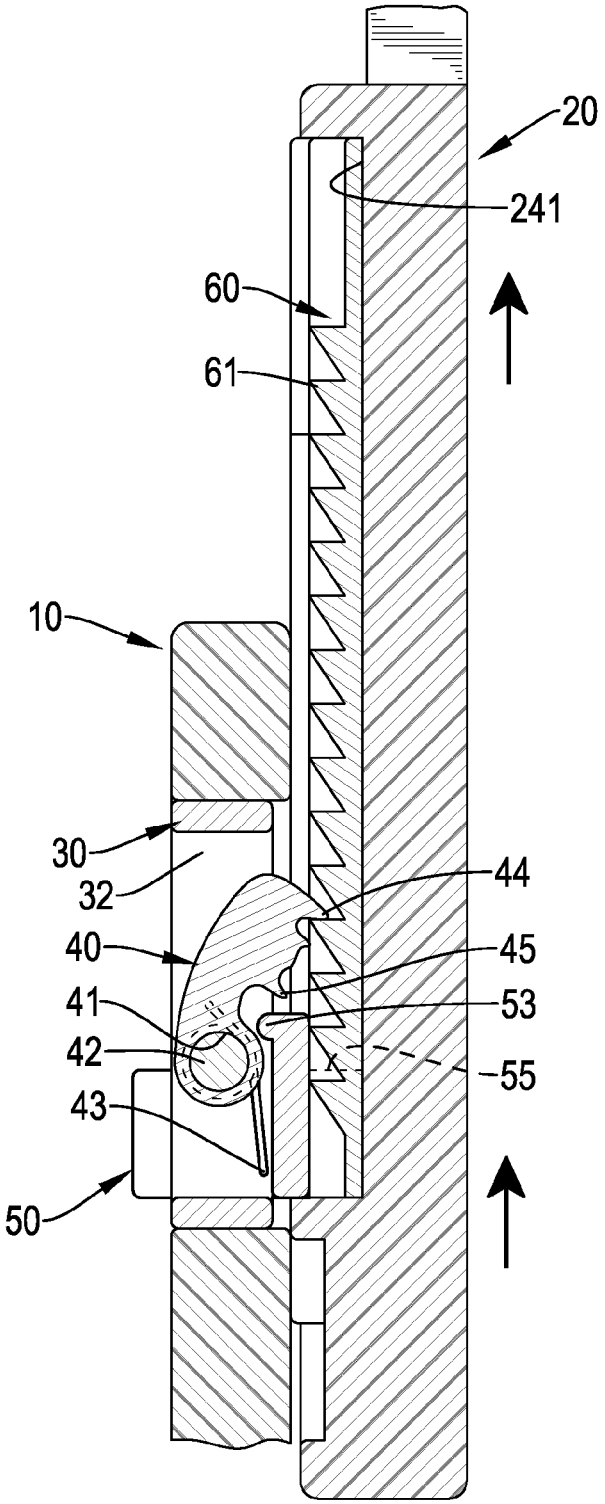
FIG. 8 is a second sectional operational view of height adjustment of the head support in the present invention.
Figure 9:
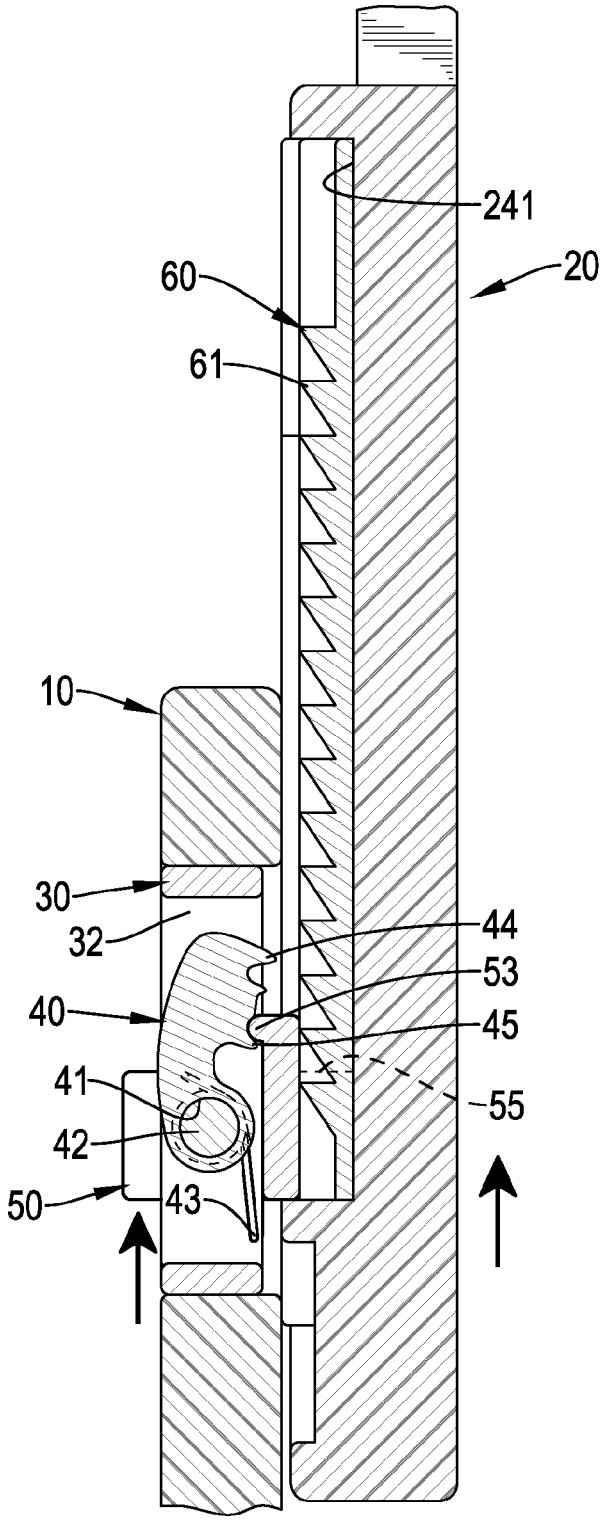
FIG. 9 is a third sectional operational view of height adjustment of the head support in the present invention.

Accordingly, the rotating block 40 forces the latch 44 to be positioned and engaged with the one-way latch 61 of the latch base 60 by an elastic force of the torque spring 43, so the head support 20 is maintained at a specific height. When the head support 20 is required to be pulled up, the head support 20 is directly pulled up and the relative position between the latch 44 and the latch base 60 is varied. Therefore, the height of the head support 20 is increased. With reference to FIG. 8, when the head support 20 is required to be moved down, the head support 20 has to move to an unlocked position that is the highest position. When the head support 20 is moved up to the highest point, the lower end of the notch 23 pushes the limiting block 55 of the moving base 50 up to let the moving base 50 move upward. Therefore, the pushing sheet 53 of the moving base 50 pushes the bump 45 of the rotating block 40 up and the pushing sheet 53 is engaged with the bump 45 and the latch 44 is not engaged with the one-way latches 61. As shown in FIG. 9, therefore, the head support 20 can be pushed down by pushing the limiting block 55 of the moving base 50 down from the upper end of the notch 23. At this moment, since the locking is released, the rotating block 40 forces the latch 44 to be engaged with the one-way latch 61 by the torque spring 43 again.

Accordingly, the height of the head support in accordance with the present invention is adjustable. Therefore, different people or a person with different requirements can adjust the height of the head support in accordance with the need to properly support the neck.

What is claimed is:

1. An adjustable head support apparatus comprising:

a head support disposed on a rear end of a seat back of a chair and including:

a bottom surface facing the rear end of the seat back;

two through grooves in an elongated shape respectively formed in two sides of the bottom surface of the head support;

two fastening elements respectively mounted through the through grooves and fixed on the seat back; and two notches formed in parallel and disposed on the bottom surface in an area located between the two through grooves, and an adjusting assembly for height adjustment of the head support disposed between the seat back and the head support, the adjusting assembly including:

a positioning base having:

a first recessed area formed below a centre of the positioning base; and two second recessed areas respectively formed at two lower sides of the positioning base;

a rotating block pivotally mounted on the positioning base within the first recessed area and having:

a latch formed on and inclined from an upper end to a rear end of the rotating block; and a bump formed on and extending from a lower end of the latch;

a moving base disposed at a rear end of the positioning base, and having:

a pushing sheet formed at a centre of the moving base, extending upward, and corresponding to a position of the latch of the rotating block;

two limiting blocks respectively protruding from two sides of a rear end of the moving base and corresponding to positions of the notches of the head support, wherein when the head support is moved up such that lower edges of the two notches contact the limiting block, the head support pulls the moving base upward; and a latch base embedded between the two notches of the head support and having a plurality of one-way latches disposed horizontally on a front surface of the latch base; and a torque spring disposed within a positioning groove of the seat back and forcing the latch of the rotating block to rotate backward to engage with the latch base of the head support without external force.

2. The adjustable head support apparatus as claimed in claim 1, wherein two wings are formed at two sides of the moving base and extending forward;

two barrier plates are respectively formed at two front ends of the two wings and further extending outward; and the wings are disposed within the second recessed area at two sides of the positioning base.

3. The adjustable head support apparatus as claimed in claim 1, wherein:

the positioning base has a through-hole communicating between one of the second recessed areas and the first recessed area;

a passing hole is formed at a lower end of the rotating block and corresponding to the through-hole; and a rod is mounted into the through-hole of the positioning base and the passing hole of the rotating block so that the rotating block is pivotally mounted on the positioning base in the first recessed area.

4. The adjustable head support apparatus as claimed in claim 2, wherein:

the positioning base has a through-hole communicating between one of the second recessed areas and the first recessed area;

a passing hole is formed at a lower end of the rotating block and corresponding to the through-hole; and a rod is mounted into the through-hole of the positioning base and the passing hole so that the rotating block is pivotally mounted on the positioning base in the first recessed area.

5. The adjustable head support apparatus as claimed in claim 3, wherein one end of the torque spring is fixed on an end edge of a fixing groove and forms a positioning point, and the other end of the torque spring is inserted in one upper side of the rotating block to let the latch of the rotating block rotate backward.

6. The adjustable head support apparatus as claimed in claim 4, wherein one end of the torque spring is fixed on an end edge of a fixing groove and forms a positioning point, and the other end of the torque spring is inserted in one upper side of the rotating block to let the latch of the rotating block rotate backward.

* * * * *